US006663439B2

(12) United States Patent
Henry et al.

(10) Patent No.: US 6,663,439 B2
(45) Date of Patent: Dec. 16, 2003

(54) ELECTRICAL CONNECTOR WITH SPRING BIASED CONTACTS

(75) Inventors: Randall R. Henry, Harrisburg, PA (US); Michael J. Phillips, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/085,720

(22) Filed: Feb. 27, 2002

(65) Prior Publication Data

US 2002/0123271 A1 Sep. 5, 2002

Related U.S. Application Data

(60) Provisional application No. 60/272,978, filed on Mar. 2, 2001.

(51) Int. Cl.[7] ..... H01R 13/24
(52) U.S. Cl. ..... 439/700
(58) Field of Search ..... 439/700, 66, 246

(56) References Cited

U.S. PATENT DOCUMENTS 5,727,954 A * 3/1998 Kato et al. ..... 439/66

* cited by examiner

*Primary Examiner*—Gary Paumen

(57) ABSTRACT

An electrical connector is provided including a housing and a cap having a first end that engages a mating contact and an open second end. The electrical connector includes a plunger contact having a first end projecting from the housing that engages a mating contact and a second end with a spring retention area that telescopically communicates with the open second end. The plunger contact and the cap move relative to one another along a contact motion axis. The electrical connector includes a spring provided between the plunger contact and the cap that engages the spring retention area. At least one of the plunger contact and cap include an angled surface that biases the spring at an acute angle to the contact motion axis to induce a lateral binding force between the plunger contact and the cap that causes the plunger contact and the cap to maintain a direct electrical connection therebetween.

20 Claims, 5 Drawing Sheets

ELECTRICAL CONNECTOR WITH SPRING BIASED CONTACTS

RELATED APPLICATIONS

This application is related to, and claims priority from, Provisional Application No. 60/272,978 filed Mar. 2, 2001, titled "Spring Probe Electrical Connector", the complete subject matter of which is incorporated herein by reference in its entirety.

BACKGROUND OF THE INVENTION

Certain embodiments of present invention relate to an electrical connector for interconnecting electronic components, such as a battery and printed circuit board. More particularly, certain embodiments of the present invention relate to an electrical connector having spring-biased plunger contacts for an electrical connector.

In certain applications, such as a cell phone with a charger, a battery in the cell phone is electrically connected to a printed circuit board in the charger to be recharged when the cell phone is placed in the charger. Typically, the charger includes an electrical connector with spring-biased plunger contacts connected to the printed circuit board. The plunger contacts extend into the cradle area in the charger where the cell phone is placed. The plunger contacts are positioned in the cradle area to align with mating contacts on the cell phone when the cell phone is inserted into the cradle area.

The typical electrical connector of the foregoing type includes a rectangular housing with a mating face opposite an open side of the housing. The housing carries cylindrical casings that are open at one end along the mating face and that have closed contact bases at an opposite end along the open side of the housing. The closed contact bases are connected to the printed circuit board. The casings retain springs and cylindrical or bullet shaped contacts with the springs positioned between an end of the bullet contacts and contact bases. An opposite end of the bullet contacts extends partially through the open ends of the casings at the mating face of the housing. When a cell phone is mounted to the mating face, the bullet contacts engage mating contacts on the cell phone to join its battery. The bullet contacts are pushed downward into the casings, thereby compressing the springs. Thus an electrical path is formed that extends from the battery to the printed circuit board successively through the mating contacts on the cell phone to the bullet contacts, the springs, and the contact bases in the charger.

However, the typical electrical connector of the above noted type suffers from certain drawbacks. First, the cylindrical bodies of the bullet contacts are manufactured by a screw-machining process which is expensive and time-consuming because each bullet contact is machined from pre-existing metal stock. Secondly, the electrical connectors are time-consuming and expensive to assemble because each spring and bullet contact is separately loaded into a casing, and then the casings are loaded into the housing. Finally, the electrical path through the electrical connector is extensive. An electrical current travels from the bullet contact through the coils of the spring before reaching the contact base. The electrical current may pass through the length of the spring directly along the coils or, if the spring is completely compressed and the coils are contacting each other, from coil to coil. Because either such electrical path through the spring is extensive, an electrical current traveling through the spring encounters resistance. To overcome the resistance of the electrical path, more power is required to maintain an adequate supply of electrical current between the battery and the printed circuit board.

Therefore, a need exists for an electrical connector that overcomes the above problems and addresses other concerns experienced in the prior art.

BRIEF SUMMARY OF THE INVENTION

Certain embodiments provide for an electrical connector including a housing having a contact retention chamber and first and second mating faces configured to engage mating contacts. The electrical connector includes a cap having a first end configured to engage a mating contact and a second end being open. The electrical connector includes a plunger contact having a first end projecting from the housing. The first end is configured to engage a mating contact. The plunger contact has a second end that includes a spring retention area and that telescopically communicates with the cap. The plunger contact and the cap move relative to one another along a contact motion axis. The electrical connector includes a spring provided between the plunger contact and the cap that engages the spring retention area of the plunger contact along a contact/spring interface. At least one of the plunger contact and cap define the contact/spring interface to have an angled interface that biases the spring at an acute angle to the contact motion axis in order to induce a lateral binding force between the plunger contact and the cap. The lateral binding force causes the plunger contact and the cap to maintain a direct electrical connection therebetween independent of the spring during movement along the contact motion axis.

BRIEF DESCRIPTION OF SEVERAL VIEWS OF THE DRAWINGS

FIG. 2 illustrates an isometric section view of the electrical connector of FIG. 1 taken along section 2—2 of FIG. 1.

Figure 1:
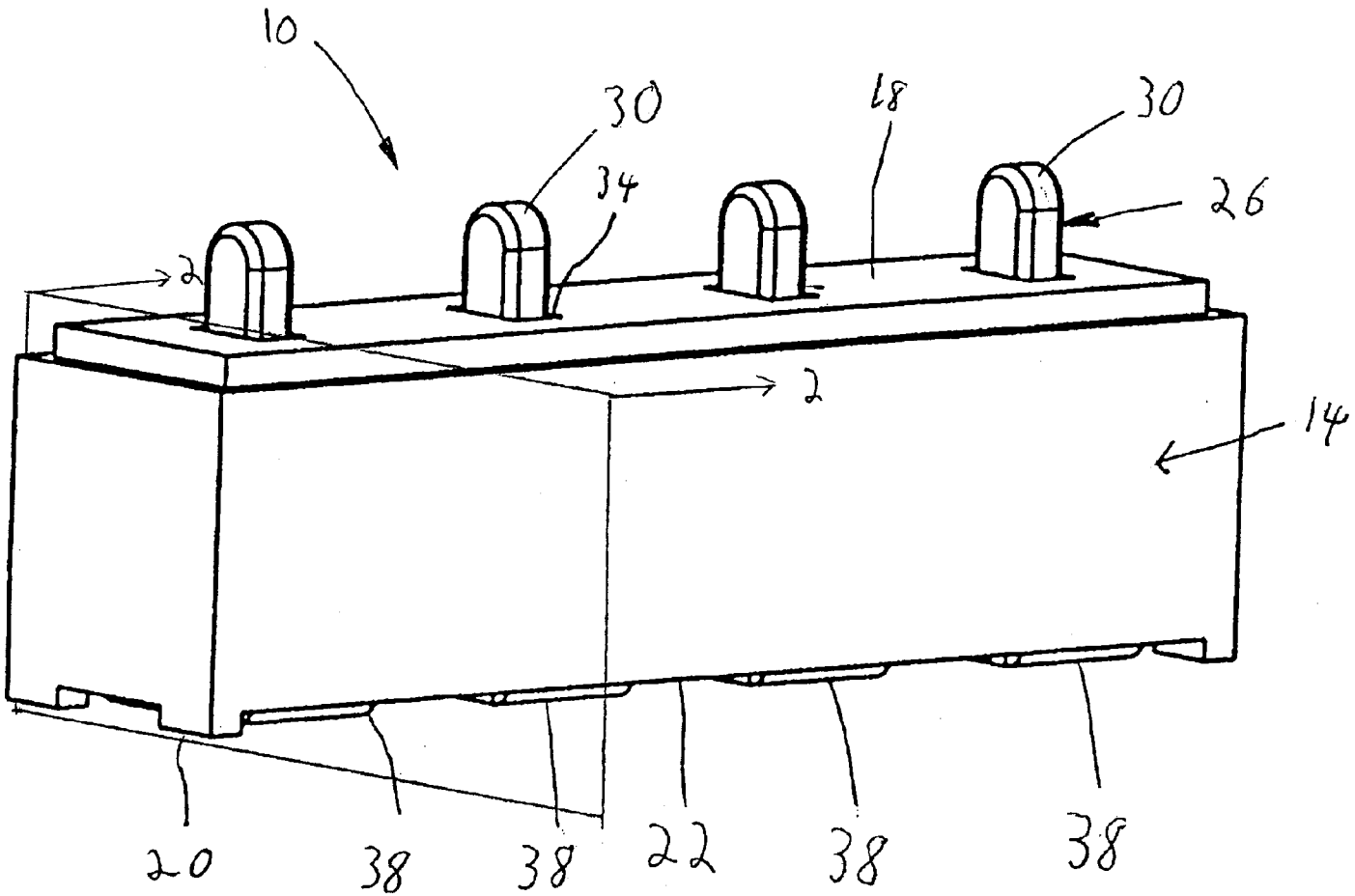
FIG. 1 illustrates a side isometric view of an electrical connector formed according to an embodiment of the present invention.
Figure 6:
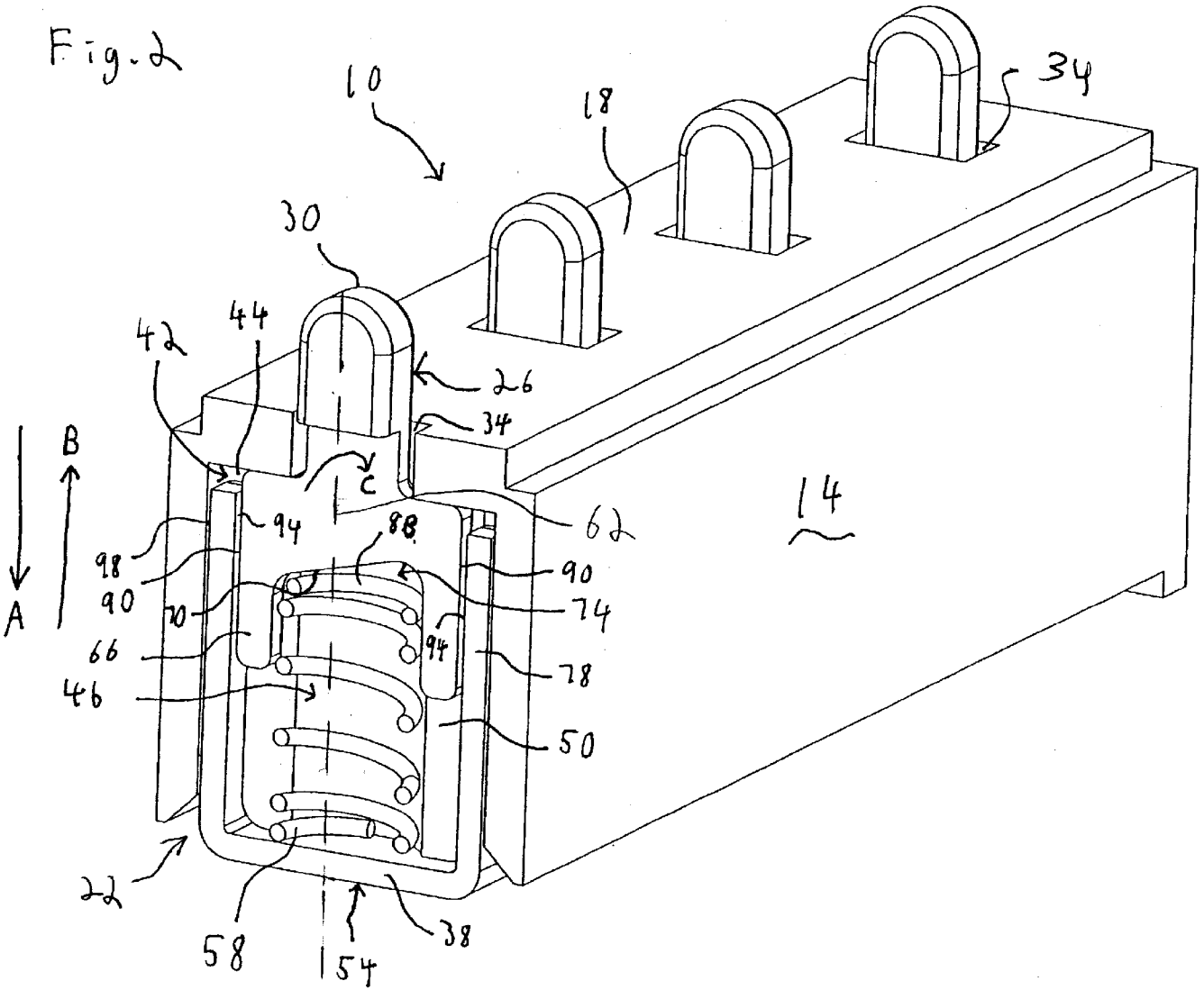

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates a side isometric view of an electrical connector 10 formed according to an embodiment of the present invention. The electrical connector 10 includes an insulative housing 14 having a rectangular mating face 18 that engages an electronic component such as a battery (not shown) and a mounting side 22 that is secured to a printed circuit board (not shown) along support legs 20. The housing 14 retains plunger contacts 26 each having a rounded plunger portion 30 that extends through a respective aperture 34 in the mating face 18 of the housing 14 for engagement with the battery. Rectangular contact plates 38 corresponding to the plunger contacts 26 are disposed on the mounting side 22 of the housing 14 for engagement with conductive contacts (not shown) on the printed circuit board. The term contact is used broadly and includes pads formed on the printed circuit board at ends of electrical traces. Thus, the electrical connector 10 electrically interconnects the battery with the printed circuit board.

FIG. 2 illustrates an isometric section view of the electrical connector 10 of FIG. 1 taken along section 2—2 of FIG. 1. The housing 14 includes a contact retention chamber 42 that is divided into contact compartments 46 by interior walls 44 that may include curved partitions 50. Each contact compartment 46 retains a plunger contact 26, a cap 54, and a spring 58. Each contact compartment 46 is aligned with a corresponding aperture 34 in the mating face 18 such that when the plunger contacts 26 are inserted into the contact compartments 46, the plunger portions 30 of the plunger contacts 26 extend through the apertures 34. The partitions 50 are configured to closely surround each spring 58 and each plunger contact 26, thereby stabilizing each spring 58 and guiding each plunger contact 26 for movement along an associated contact motion axis 62 as the plunger contact 26 is depressed against the spring 58 in the direction of arrow A.

Figure 3:
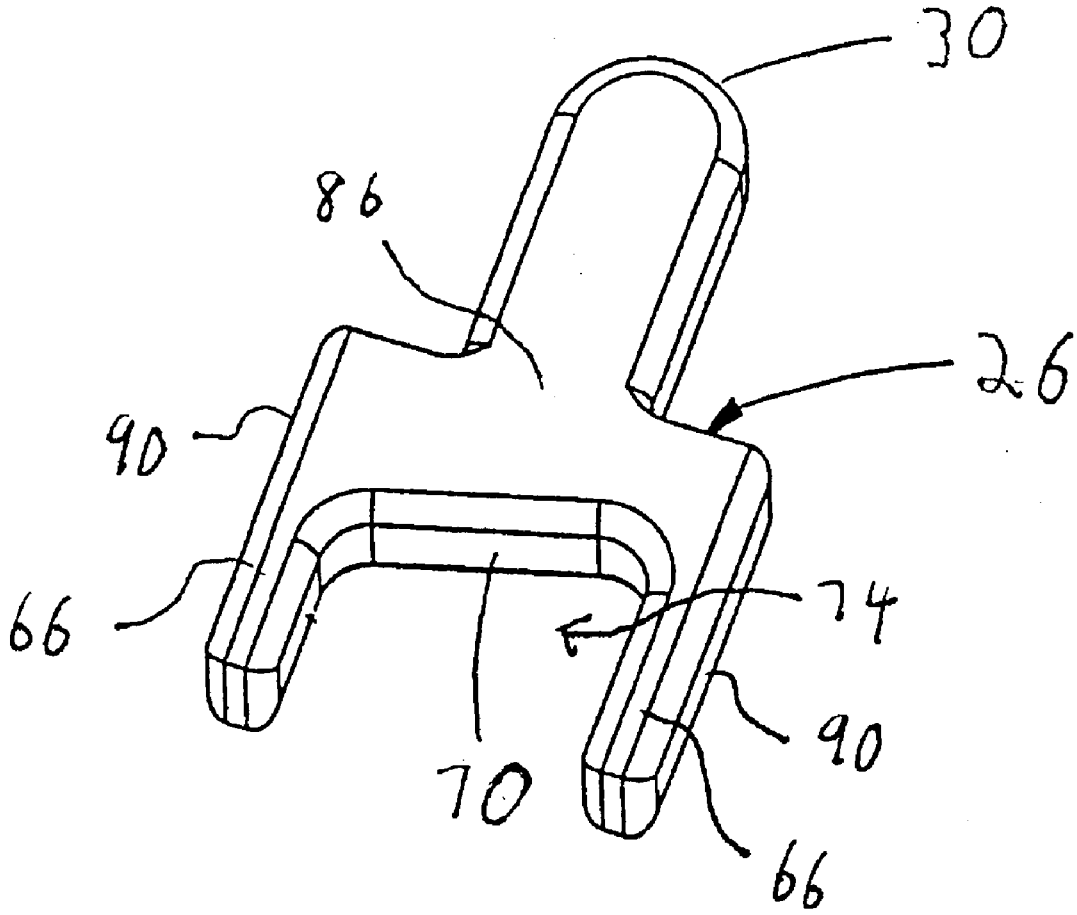
FIG. 3 illustrates a side isometric view of a plunger contact formed according to an embodiment of the present invention.

FIG. 3 illustrates a side isometric view of the plunger contact 26. The plunger contact 26 has a tuning fork shape that is stamped from an electrically-conductive material without any other particular forming steps. The plunger contact 26 includes the plunger portion 30 extending from one end of an intermediate portion 86 and legs 66 extending from an opposite end of the intermediate portion 86. The legs 66 have exterior surfaces 90 that face outward from one another. A spring abutment surface 70 extends along the end of the intermediate portion 86 between the legs 66 to define a spring retention area 74. The spring abutment surface 70 is formed at an acute angle with respect to the contact motion axis 62 of FIG. 2. The spring retention area 74 receives a first end of the spring 58 (FIG. 2) as the spring 58 engages the spring abutment surface 70, and the legs 66 move telescopically within the cap 54.

Figure 4:
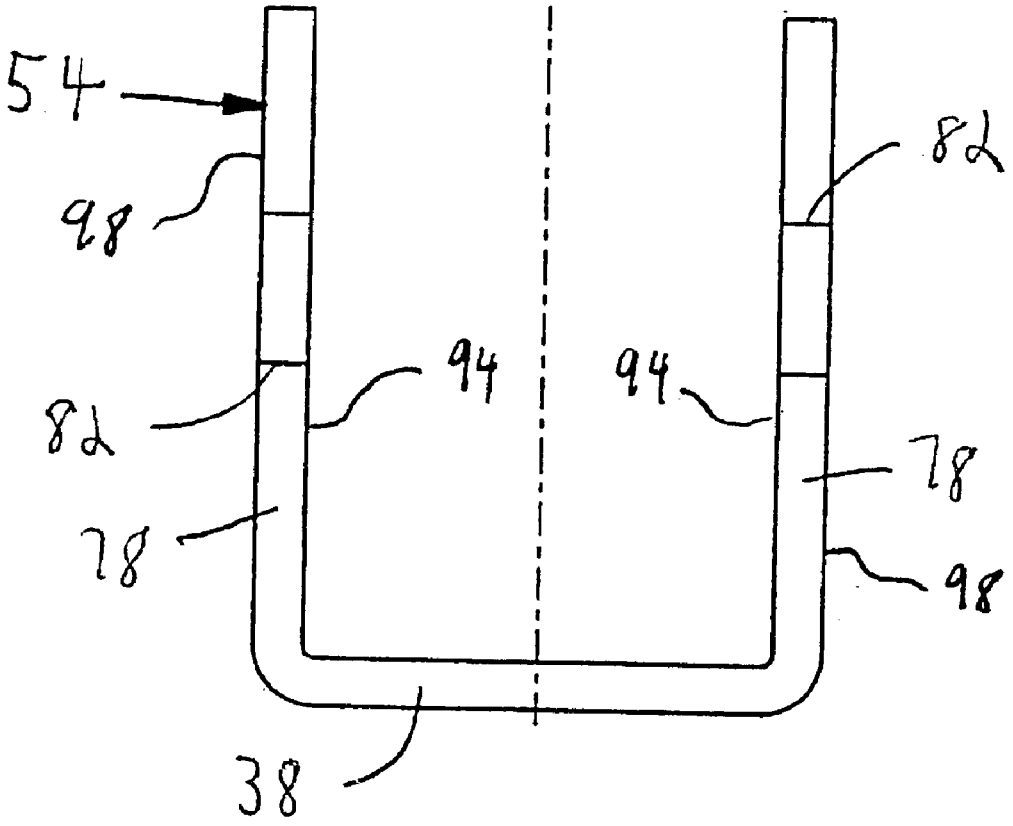
FIG. 4 illustrates a front view of a cap formed according to an embodiment of the present invention.
Figure 5:
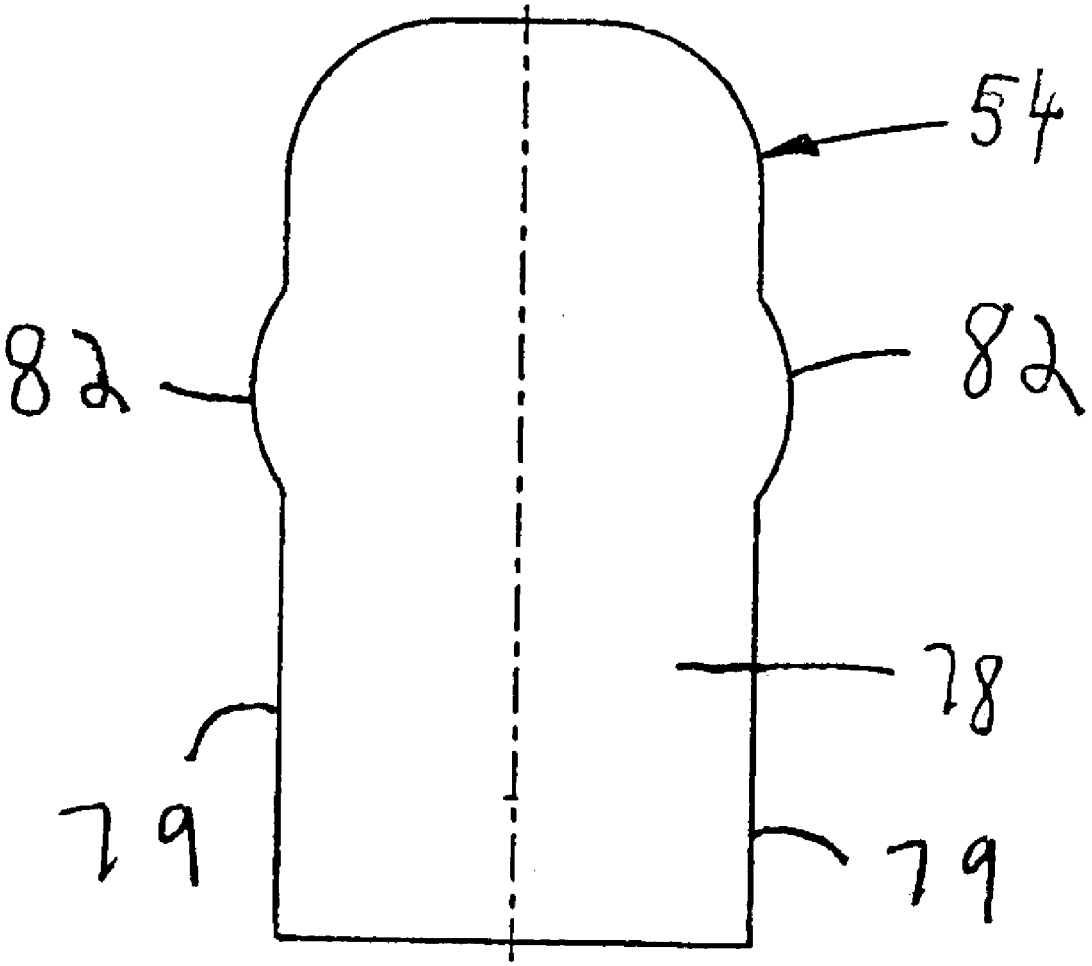
FIG. 5 illustrates a side view of a portion of a beam formed according to an embodiment of the present invention.

FIG. 4 illustrates a front view of the cap 54. The cap 54 is stamped from a single piece of electrically-conductive material into a U-shape. The cap 54 includes the contact plate 38 with beams 38 extending upward from opposite ends thereof parallel to one another. The beams 78 have interior surfaces 94 and exterior surfaces 98. As better shown in FIG. 5, barbs 82 extend transversely from sides 79 of the beams 78 and are dimensioned to form an interference-fit between the partitions 50 of the housing 14 (FIG. 2). Alternatively, the cap 54 may not be planar, but instead may be another shape such as circular, tubular, or cup-shaped. Optionally, the partitions 50 may be correspondingly dimensioned to receive the cap 54 in such other shapes to form an interference fit therebetween.

Returning to FIG. 2, during assembly the plunger contacts 26 are attached to a carrier strip (not shown) which is used to insert the plunger contacts 26 through the mounting side 22 of the housing 14 in the direction of arrow B into the contact compartments 46 until the plunger portions 30 extend upward through corresponding apertures 34. The carrier strip is then cut away from the plunger contacts 26 and the springs 58 are inserted upward in the direction of arrow B into the contact compartments 46 until being located within the spring retention areas 74 of the plunger contacts 26. The caps 54 then are inserted into the corresponding contact compartments 46 until the beams 78 are positioned between the partitions 50 and the interior walls 44 of the housing 14. The barbs 82 on the beams 78 (FIGS. 4 and 5) engage the partitions 50 to retain the caps 54 in place, which in turn holds the springs 58, and the plunger contacts 26 in the contact compartments 46.

Top coils 88 of the springs 58 are positioned between the legs 66 of the plunger contacts 26 and engage and support the plunger contacts 26 along the spring abutment surfaces 70. The legs 66 in turn are positioned between the beams 78 of the caps 54. The contact plates 38 of the caps 54 may then be soldered to the printed circuit board.

In operation, the mating contacts of an electronic component, such as a cell phone battery are positioned on the mating face 18 until electrically engaging corresponding plunger portions 30. The weight of the electronic component causes the plunger portions 30 to move downward in the direction of arrow A such that the springs 58 are compressed between the spring abutment surfaces 70 and the contact plates 38. The legs 66 of the plunger contacts 26 contemporaneously move downward in the direction of arrow A relative to the beams 78 along the contact motion axis 62. Because the spring abutment surfaces 70 are aligned at an acute angle to the contact motion axis 62, the plunger contacts 26 experience a pivot force in the direction of arrow C. As the plunger contacts 26 pivot, the exterior surfaces 90 of the legs 66 on the plunger contact 26 engage the interior surfaces 94 of the beams 78 on the cap 54 thereby creating an electrical path between the battery and the printed circuit board. The spring abutment surfaces 70 and the springs 58 thus interact to induce a lateral binding force between the plunger contacts 26 and the caps 54 that forms a direct electrical connection between the plunger contacts 26 and the caps 54. As the plunger contacts 26 are further depressed downward-in the direction of arrow A, the exterior surfaces 90 and interior surfaces 94 maintain contact through telescopic motion by slidably engaging each other.

Alternatively, when the electronic component is removed from the mating face 18, the plunger contacts 26 are deflected upward in the direction of arrow B by the springs 58. The legs 66 of the plunger contacts 26 disengage from the beams 78 of the caps 54 and return to an unbiased position resting upon the springs 58 with the plunger portions 30 extending through the apertures 34 of the mating face 18.

In an alternative embodiment of the electrical connector 10, the angled spring abutment surface 70 is located on an interior side of the contact plate 38 of the cap 54 and engages a second end of the spring 58. Thus the lateral binding force is created along the contact plate 38 of the cap 54 as the plunger contact 26 pushes the spring 58 downward in the direction of arrow A against the spring abutment surface 70. Optionally, the legs 66 of the plunger contact 26 may telescopically enclose the beams 78 of the cap 54 within the spring retention area 74 such that interior surfaces of the legs 66 contact the exterior surfaces 98 of the beams 78 to create the lateral binding force. In another embodiment, only one leg 66 of the plunger contact 26 engages a proximate beam 78 of the cap 54 when the spring abutment surface 70 compresses and pivots about the spring 58. Thus the electrical path extends through only the engaged leg 66 and beam 78.

The electrical connector confers several benefits. First, the electrical connector creates a direct electrical path from the plunger contact to the cap that is shorter than an electrical path from the plunger contact to the cap via the spring.

Because the electrical path is shorter, the electrical current experiences less resistance, and thus less power is necessary to electrically connect the battery with the printed circuit board. Secondly, the plunger contacts and caps are planar and may be easily stamped from metal sheets without and molding or machining. Thus, the electrical connector is inexpensive and efficient to manufacture. Finally, the electrical connector is quickly and efficiently assembled entirely within the housing by successively inserting the plunger contacts, springs, and caps.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector comprising:

a housing having first and second mating faces configured to engage mating contacts, said housing includes a contact retention chamber;

a cap secured to said housing to close said contact retention chamber, said cap having a base end configured to engage a mating contact and an open end formed with beams;

a plunger contact provided in said contact retention chamber, said plunger contact having a plunger end projecting from said housing and having a second end communicating with said open end of said cap, said plunger contact and said cap telescopically moving relative to one another along a contact motion axis, said second end of said plunger contact including a spring retention area; and a spring provided between said plunger contact and said cap, said spring engaging said spring retention area of said plunger contact, at least one of said plunger contact and cap including an inclined interface engaging said spring to pivot said plunger contact relative to said cap, thereby causing an exterior surface of said plunger contact to electrically engage an interior surface of said cap to maintain a direct electrical connection therebetween independent of said spring during at least a portion of said telescopic movement.

2. The electrical connector of claim 1, wherein said plunger contact includes legs extending from opposite sides of an angled surface defining said inclined interface, said angled surface being oriented at an acute angle to said contact motion axis.

3. The electrical connector of claim 1, wherein said cap includes beams extending from opposite sides of said inclined interface, said inclined interface being oriented at an acute angle to said contact motion axis.

4. The electrical connector of claim 1, wherein said plunger contact has legs with outer surfaces electrically engaging an interior surface of said cap.

5. The electrical connector of claim 1, wherein said cap has beams with outer surfaces electrically engaging an interior surface of said plunger contact.

6. The electrical connector of claim 1, wherein said cap is planar and has beams that extend from a contact surface at said base end, said beams electrically engage an exterior surface of said plunger contact.

7. The electrical connector of claim 1, wherein said first mating face of said housing includes apertures therein that receive said plunger ends of said plunger contact.

8. The electrical connector of claim 1, wherein said housing includes partitions within said contact retention chamber defining contact compartments containing said plunger contact, said spring, and said cap.

9. The electrical connector of claim 1, wherein said housing includes partitions dividing said contact retention chamber into contact compartments, said cap having beams with barbs that engage said partition to retain said cap, spring, and plunger contact within one of said contact compartments.

10. The electrical connector of claim 1, wherein said second mating face of said housing is open and exposes said base ends of said caps to electrically engage said mating contacts.

11. The electrical connector of claim 1, wherein said inclined interface pivots about a coil of said spring proximate said inclined interface with at least one leg of said plunger contact engaging a beam of said cap.

12. The electrical connector of claim 1, wherein said cap is one of tubular and cup-shaped, said cap telescopically communicating with legs extending from said second end of said plunger contact.

13. An electrical connector comprising:

a housing having a first mating face configured to engage an electronic component and a second mating face configured to engage a printed circuit board;

a cap secured to said housing to close said second mating face, said cap having beams extending from a base end;

a plunger contact provided in said housing, said plunger contact having a plunger end projecting from said housing and having a second end communicating with said beams of said cap, said plunger contact and said cap moving relative to one another along a contact motion axis; and a spring provided between said plunger contact and said cap, said plunger contact including an inclined interface engaging said spring to pivot said plunger contact relative to said cap, thereby causing an exterior surface of said plunger contact to electrically engage an interior surface of said cap to maintain a direct electrical connection therebetween independent of said spring.

14. The electrical connector of claim 13, wherein said plunger contact includes legs extending from opposite sides of an angled surface defining said inclined interface, said angled surface being oriented at an acute angle to said contact motion axis.

15. The electrical connector of claim 13, wherein said plunger contact has legs with outer surfaces electrically engaging an interior surface of said cap.

16. The electrical connector of claim 13, wherein said cap has beams with outer surfaces electrically engaging an interior surface of said plunger contact.

17. The electrical connector of claim 13, wherein said cap is planar and has beams electrically engaging an exterior surface of said plunger contact.

18. The electrical connector of claim 13, wherein said first mating face of said housing includes apertures therein that receive said plunger ends of said plunger contact.

19. The electrical connector of claim 13, wherein said housing includes partitions defining contact compartments, said cap having beams having barbs that engage said partitions to retain said cap, spring, and plunger contact within one of said contact compartments.

20. The electrical connector of claim 13, wherein said inclined interface pivots about a coil of said spring proximate said inclined interface with at least one leg of said plunger contact engaging a beam of said cap.

* * * * *